US005638087A

United States Patent [19]

Tanaka et al.

[11] Patent Number: 5,638,087

[45] Date of Patent: Jun. 10, 1997

[54] DOT MATRIX TYPE LIQUID CRYSTAL DISPLAY APPARATUS

[75] Inventors: Toshihiko Tanaka; Norimitsu Kobayashi; Shoji Iwasaki, all of Tottori, Japan

[73] Assignees: Sanyo Electric Co., Ltd., Moriguchi; Tottori Sanyo Electric Co., Ltd., Tottori, both of Japan

[21] Appl. No.: 265,626

[22] Filed: Jun. 24, 1994

Related U.S. Application Data

[63] Continuation of Ser. No. 3,018, Jan. 11, 1993, abandoned.

[51] Int. Cl.[6] ..... G09G 3/18

[52] U.S. Cl. ..... 345/87; 345/211; 330/260

[58] Field of Search ..... 323/280; 330/99, 330/100, 105, 252, 282, 260, 254, 228; 345/87, 98, 94, 211, 212, 208; 359/55, 56, 59

[56] References Cited

U.S. PATENT DOCUMENTS

| | | | |
|---|---|---|---|
| 3,512,101 | 5/1970 | Ellermeyer | 330/99 |
| 5,117,298 | 5/1992 | Hirai | 340/784 |
| 5,191,278 | 3/1993 | Carpenter | 323/280 |

FOREIGN PATENT DOCUMENTS

| | | | |
|---|---|---|---|
| 0050148 | 4/1977 | Japan | 330/100 |
| 3-1120 | 1/1991 | Japan . | |
| 3-50494 | 10/1991 | Japan . | |
| 3-253817 | 11/1991 | Japan . | |
| 2116793 | 9/1983 | United Kingdom | 330/282 |

OTHER PUBLICATIONS

R. D. Gillingham "Differential Amplifier with DC Restore" IBM Technical Disclosure Bulletin vol. 23 No. 9 Feb. 1981.

Ross Nimno "Composite Buffer Provides Speed and Accuracy" Design Ideas Electronic Product Design, Aug. 1981 vol. 2 Iss. 8.

*Primary Examiner*—Richard Hjerpe
*Assistant Examiner*—Lun-Yi Lao
*Attorney, Agent, or Firm*—Nikaido, Marmelstein, Murray & Oram LLP

[57] ABSTRACT

A liquid crystal display apparatus is driven by a voltage averaging method. The display apparatus is provided with voltages via a scanning circuit and a driver circuit from a power supplying circuit. The power supplying circuit has a voltage compensating circuit which is provided with an operational amplifier whose first input terminal is provided with a predetermined voltage and whose second input terminal is connected to an output terminal thereof through a resistor, an impedance circuit connected between the output terminal of the operational amplifier and an output terminal of the power supplying circuit, and feedback circuit for feeding back both of an alternating current component and a direct current component of an output of the impedance circuit to the second input terminal of the operational amplifier.

14 Claims, 9 Drawing Sheets

Driver circuit
Liquid crystal cell
Scanning circuit
Voltage compensating circuit
Voltage compensating circuit
Power supplying circuit
TR
R15
R14
R13
R12
R11
VH
VSH
VDH
VDL
VSL
VL
a
b
c
d
e
f
1
2
3
4
5
6
7
8
9
10
11
11

DOT MATRIX TYPE LIQUID CRYSTAL DISPLAY APPARATUS

This application is a continuation of application Ser. No. 08/003,018 filed Jan. 11, 1993, now abandoned.

BACKGROUND OF THE INVENTION

1. Field of the Invention

The present invention relates to a dot matrix type liquid crystal display apparatus, and more particularly, to a liquid crystal display apparatus driven by a voltage averaging method.

2. Description of the Prior Art

In a liquid crystal display apparatus using a so-called simple matrix type liquid crystal cell, conventionally, a scanning circuit and a driver circuit (these circuits are generally named as row and column circuits for driving row and column electrodes which are referred to as scanning and signal electrodes in this specification) are connected to the liquid crystal cell, and a selecting voltage and a non-selecting voltage are supplied from a power supplying circuit to drive the liquid crystal cell by a voltage averaging method. With this arrangement, however, an undesired display called a ghost appears as described in Japanese Laid-open Patent Application No. H2-245726. The ghost is a weak shadow-like display appearing on an extension of display pixels (selected pixels) when, for example, a bar chart or a frame is displayed.

To overcome such a problem of the ghost, a method in which the bias voltage is changed and a method in which a capacitor is provided have been used for a long time. For example, the above-mentioned Japanese Laid-open Patent Application proposes to increase a scanning side non-selected bias voltage. In another known method, variation in each bias voltage is absorbed by connecting a capacitor between a reference bias voltage line and another bias voltage line. However, since these methods do not always realize sufficient voltage compensation, although no problems arise in the case of a liquid crystal display apparatuses having a small number of display pixels, it is impossible to restrain the remarkable appearance of ghosts in liquid crystal display apparatuses having a large number of display pixels. Moreover, even in the case of the liquid crystal display apparatuses having a small number of display pixels, ghosts remarkably appear when the ambient temperature varies.

Hereinafter, one of the factors which are presumed to be reason why the ghost appears more remarkably when the number of display pixels is large will be described. Generally, the relationship between a liquid crystal applied voltage and a light transmittance is represented by the characteristic shown in FIG. 16. The axis of the abscissa of FIG. 16 represents a voltage applied to the liquid crystal cell, and the axis of the ordinate represents a light transmittance T. Numeral 61 represents a light transmittance curve of an ON pixel, and 62 is a light transmittance curve of an OFF pixel. Vop represents a normal working voltage, which represents a peak value of the selecting voltage for the ON pixel and a peak value of the non-selecting voltage for the OFF pixel. When the number of scanning electrodes of a liquid crystal display apparatus is small and a time-division number N is small, since the ON and OFF curves are sufficiently away from each other as shown in FIG. 17, even if the ON and OFF curves change to 61*a* and 62*a*, 61*b* and 62*b* and 61*c* and 62*c* due to a variation in voltage, no problems arise since the working voltage Vop intersects constant transmittance portions of the curves. However, when the number of scanning electrodes of a liquid crystal display apparatus increases and the time-division number N also increases, the distance between the ON and OFF curves decreases as shown in FIG. 18. Since the working voltage intersects inclining portions of the curves 61*a*, 61*b*, 61*c*, 62*a*, 62*b* and 62*c* for this reason, when the voltage varies, a point $T_{ON}$ at which the pixels are ON and a point $T_{OFF}$ at which the pixels are OFF vary to points $\Delta T_{ON}$ and $\Delta T_{OFF}$ as shown in FIG. 18, so that the contrast (a ratio of $T_{ON}$ to $T_{OFF}$) changes. On the other hand, in a case where the selecting voltage is applied to specific continuous pixels such as where a bar chart is displayed in a part of an image plane, voltage variations are prone to be generated in the non-selecting voltage which counteracts the selecting voltage at pixels located in an extension of the display. At this time, ghosts appear under a condition where the above-mentioned contrast variation is readily caused.

SUMMARY OF THE INVENTION

An object of the present invention is to provide a liquid crystal display apparatus which provides a high-grade display with few ghosts being generated regardless of the number of display pixels.

According to one feature of the present invention, a liquid crystal display apparatus is provided with a liquid crystal cell including a first electrode group and a second electrode group which intersect each other, a scanning circuit connected to the first electrode group, a driver circuit connected to the second electrode group, a power supplying circuit for providing to the scanning circuit and to the driver circuit a selecting voltage and a non-selecting voltage so that the liquid crystal cell is driven by a voltage averaging method, and a voltage compensating circuit provided to the power supplying circuit for compensating for an output voltage at the power supplying circuit in accordance with a value of an output current of the power supplying circuit, said voltage compensating circuit comprising an operational amplifier whose first input terminal is provided with a predetermined voltage and whose second input terminal is connected to an output terminal thereof through a resistor, an impedance circuit connected between the output terminal of the operational amplifier and an output terminal of the power supplying circuit, and feedback means for feeding back both of an alternating current component and a direct current component of an output of the impedance circuit to the second input terminal of the operational amplifier.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
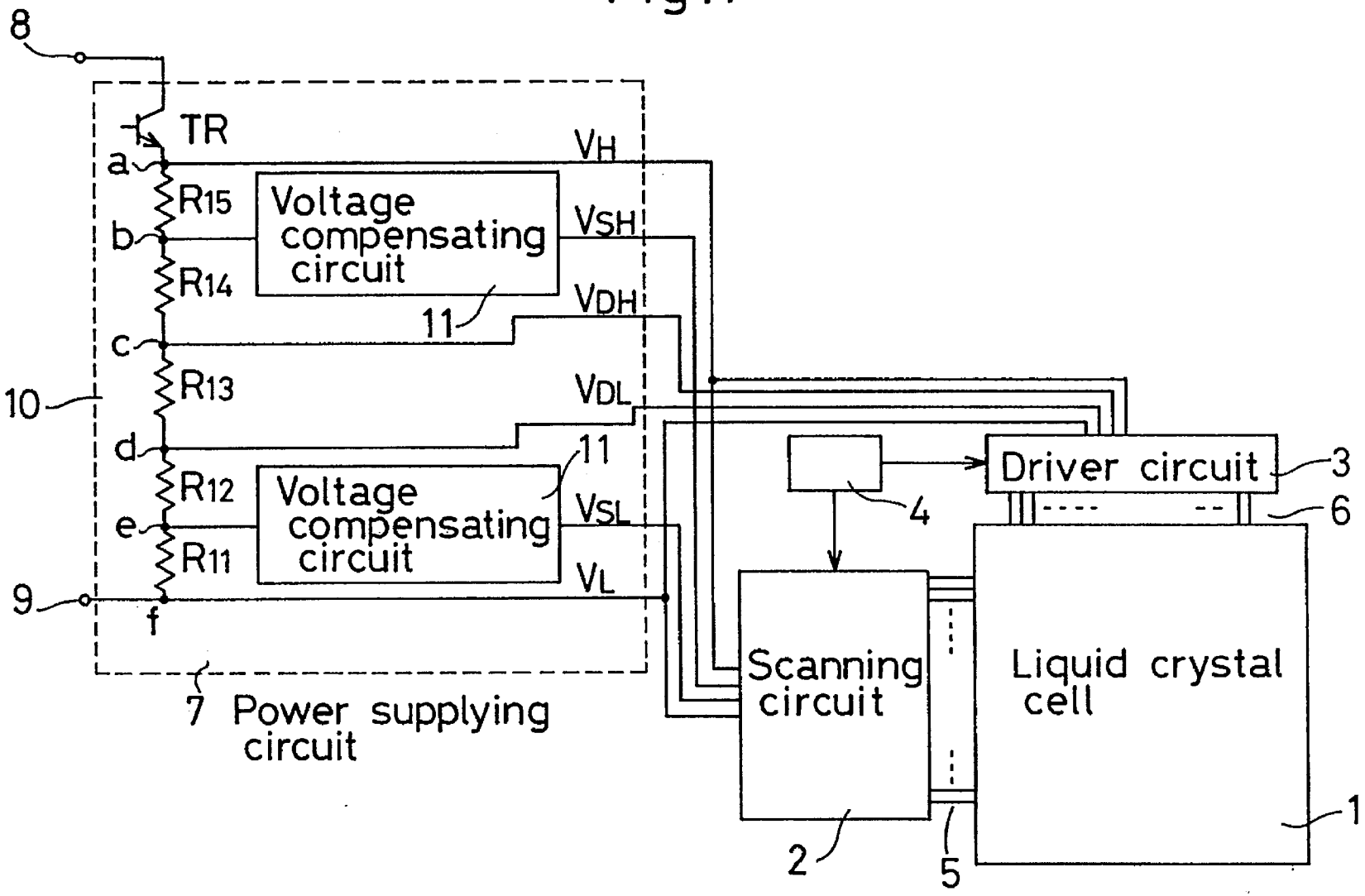
FIG. 1 is a block circuit diagram of a liquid crystal display apparatus embodying the present invention.
Figure 2:
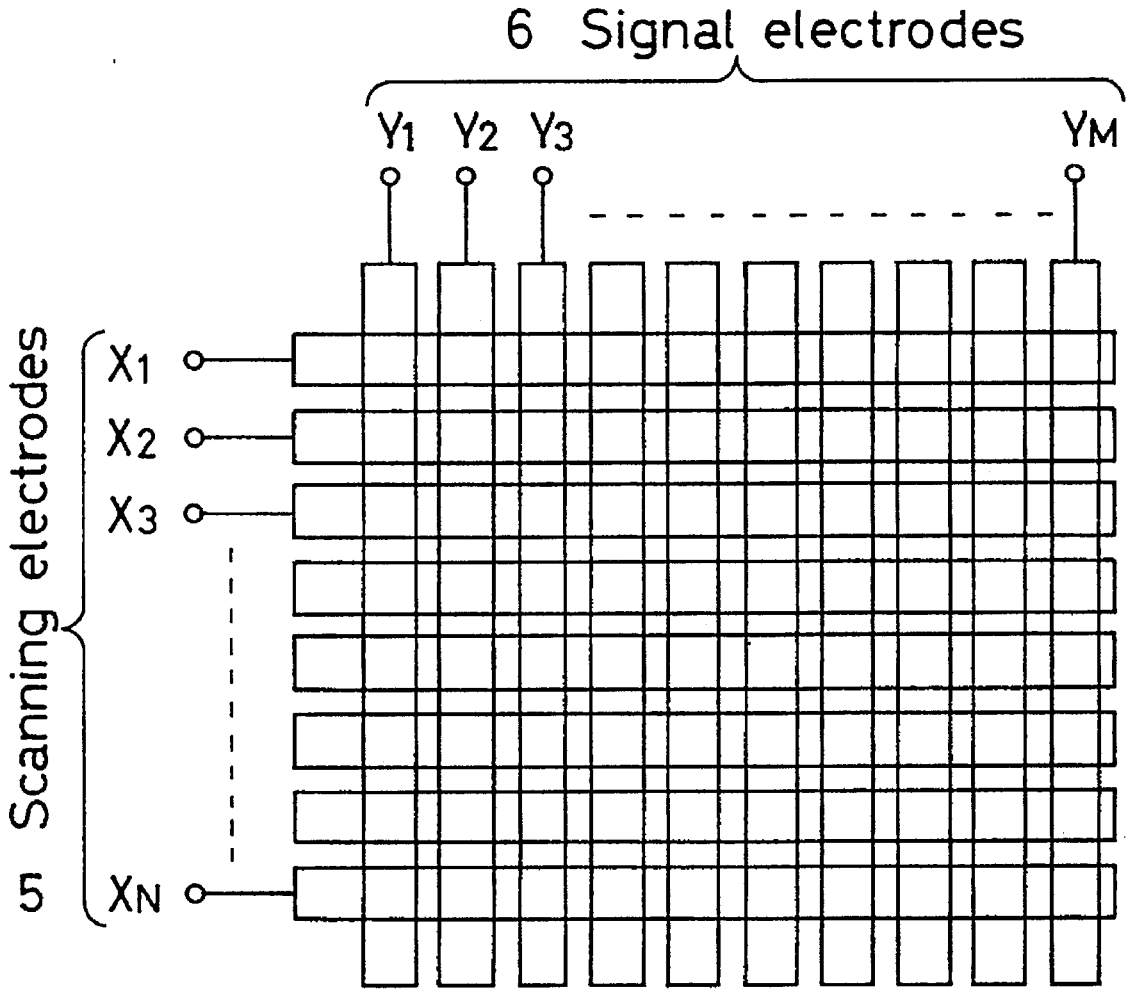
FIG. 2 is a plan view showing scanning electrodes and signal electrodes of a liquid crystal cell.

The present invention will hereinafter be described with reference to the drawings. FIG. 1 shows a general circuit arrangement of a liquid crystal display apparatus of the present invention. Numeral 1 represents a liquid crystal cell having a plurality of electrodes which intersect with each other with a liquid crystal layer therebetween, i.e. scanning electrodes 5 and signal electrodes 6. For example, in a field effect liquid crystal cell of a super twist type, liquid crystal molecules are twisted by 180 to 360 degrees. Numeral 2 represents a scanning circuit connected to the scanning electrodes 5 which are one of the two groups of electrodes of the liquid crystal cell 1. Numeral 3 represents a driver circuit connected to the signal electrodes 6 which are the other group of electrodes of the liquid crystal cell 1. To these circuits, a clock signal, a timing signal and a data signal are provided to drive the liquid crystal cell 1 according to the voltage averaging method. The scanning electrodes 5 and the signal electrodes 6 are shown in FIG. 2. A plurality of scanning electrodes provided with scanning signals through terminals $X_1, X_2, X_3, \ldots, X_N$ and a plurality of signal electrodes provided with display signals through terminals $Y_1, Y_2, Y_3, \ldots, Y_N$ are arranged horizontally and vertically, respectively. The two electrode groups intersect with each other with a non-illustrated liquid crystal layer therebetween. Each of the intersections corresponds to a pixel.

Instead of the above-described electrode arrangement, at one of the electrode groups, each electrode may include a line electrode to which a voltage is applied and a plurality of pixel electrodes individually provided to respective pixels. The line electrode and the pixel electrodes may be connected by a nonlinear device such as a diode and a metal-insulator-metal element. The present invention can be employed for such a liquid crystal cell where every pixel has a non-linear device.

Returning to FIG. 1, 4 represents a controlling circuit which provides a control signal to the scanning circuit 2 and to the driver circuit 3. For example, when a television video signal is displayed in the liquid crystal display apparatus, the controlling circuit 4 outputs a control signal based on the video signal. Numeral 7 represents a power supplying circuit which supplies to the scanning circuit 2 and to the driver circuit 3 a selecting voltage and a non-selecting voltage obtained through voltage division by series connected resistors. In the power supplying circuit 7, a voltage dividing circuit 10 is provided which includes resistors R11, R12, R13, R14 and R15 and a transistor TR for voltage-dividing a direct current provided between terminals 8 and 9. From voltage division points a, b, c, d, e and f, voltages $V_H$, $V_{SH}$, $V_{DH}$, $V_{DL}$, $V_{SL}$ and $V_L$ are generated, respectively. $V_H$ is a high selecting voltage common to the scanning circuit 2 and the driver circuit 3. $V_{SH}$ is a high non-selecting voltage for the scanning circuit 2. $V_{DH}$ is a high non-selecting voltage for the driver circuit 3. $V_{DL}$ is a low non-selecting voltage for the driver circuit 3. $V_{SL}$ is a low non-selecting voltage for the scanning circuit 2. $V_L$ is a low selecting voltage common to the scanning circuit 2 and the driver circuit 3. Numeral 11 represents voltage compensating circuits inserted respectively in the lines of the high non-selecting voltage $V_{SH}$ and the low non-selecting voltage $V_{SL}$ for the scanning circuit 2. The voltage compensating circuit 11 makes voltage compensation according to the value of an output current. If necessary, similar voltage compensating circuits 11 may be provided respectively in the lines of the high non-selecting voltage $V_{DH}$ and the low non-selecting voltage $V_{DL}$ for the driver circuit 3. Such a voltage compensating circuit 11 has been introduced on the presumption that ghosts result from a waveform distortion and this voltage drop. Describing a phenomenon, it is considered that ghosts appear because when a selecting voltage is applied to one of the electrode groups, the voltage applied to the liquid crystal by a non-selecting voltage applied to the other electrode group which liquid crystal voltage is to be decreased is not sufficiently decreased because the voltage application timings to the electrode groups disagree with each other due to a waveform distortion or because the non-selecting voltage is too low. Hence, adopting this idea, it is required to compensate for the voltage drop as well as to cope with voltage compensation quickly.

In the present invention, paying attention to the fact that equivalent connection resistances of the liquid crystal cell and each circuit increase because of a larger image plane, a larger capacity and a higher driving speed by a higher time-division driving of the liquid crystal apparatus, the voltage compensation is made by monitoring an output.

Figure 3:
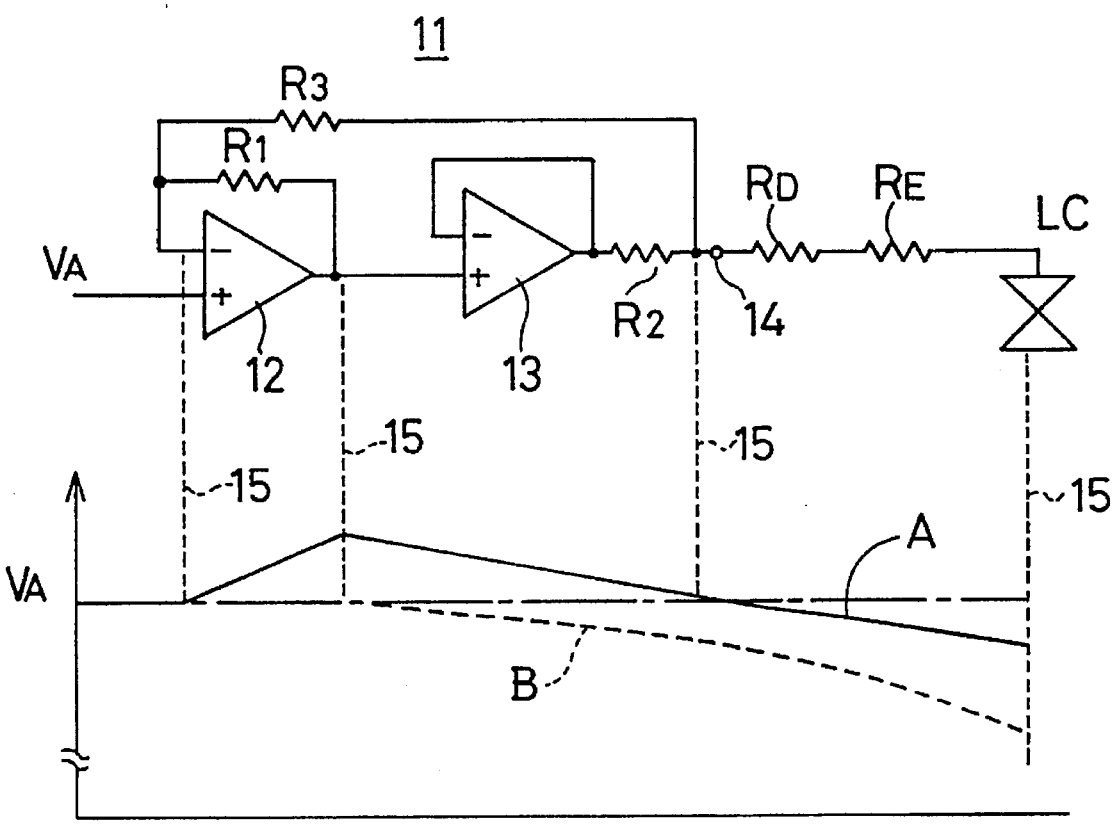
FIG. 3 is a view showing a voltage compensating circuit and a load-side portion thereof of a first embodiment of the present invention.

FIGS. 3 to 12 show examples of arrangements of the voltage compensating circuit 11. In FIG. 3, 12 is an operational amplifier supplied at its non-inverting input terminal with a non-selecting voltage $V_A$ from the voltage division circuit 10 (FIG. 1). The non-selecting voltage $V_A$ represents one of the aforementioned non-selecting voltages $V_{SH}$, $V_{DH}$, $V_{DL}$ and $V_{SL}$. An inverting input terminal of the operational amplifier 12 is connected to an output terminal thereof through a resistor R1. Numeral 13 represents an operational amplifier (hereinafter referred to as buffer) which functions as a buffer. An output of the operational amplifier 12 is applied to a non-inverting input terminal of the buffer 13. An inverting terminal and output terminal of the buffer 13 are directly connected. The gain of the buffer 13 is selected to be 1. A resistor R2 is inserted between the output terminal of the buffer 13 and an output terminal 14 of the power supplying circuit 7. The output side of the resistor R2 is connected through a resistor R3 to the inverting terminal of the operational amplifier 12. By this connection, a direct current voltage at the output terminal 14 is fed back to the inverting terminal of the operational amplifier 12.

In FIG. 3, $R_D$ represents an equivalent resistor of the scanning circuit 2 or the driver circuit 3, and $R_E$ represents an equivalent resistor of the electrodes of the liquid crystal cell 1.

When the circuit of FIG. 3 is used with respect to $V_{DH}$ and $V_{DL}$, the resistor $R_D$ is an equivalent resistor of the driver circuit 3 (for example, an internal resistance and a connection resistance of the driver circuit 3), and is approximately 0.5 to 2kΩ. The resistor $R_E$ is an equivalent resistor of the electrodes of the liquid crystal cell 1 and is, although depending on the positions of pixels, approximately 1 to 20kΩ when an anisotropic conductive film is used for connection to the driver circuit 3 and the signal electrodes 6 are made of indium tin oxide (ITO) and having a width of 100 μm. LC represents liquid crystal at each pixel. A counter electrode and the scanning circuit 2 are not shown. Hereinafter, LC will be referred to as "pixel."

In FIG. 3, as is the case with the previously-described prior art, if the non-selecting voltage $V_A$ is supplied to the output terminal 14 only through the buffer 13, when a current is supplied to the pixel LC, the voltage drops as shown by the dotted line B to remarkably reduce the voltage applied to the pixel. The degree of the voltage drop is approximately 60 to 180 mV. This means, for the previously-mentioned reason, that ghosts appear. However, in the voltage compensating circuit shown in FIG. 3, a voltage characteristic represented by the solid line A is obtained, so that the drop of the voltage applied to the pixel is sufficiently restrained. In FIG. 3, the vertical dotted lines 15 are provided in order to show correspondence between a voltage at each point of the circuit and the characteristic A.

Figure 4:
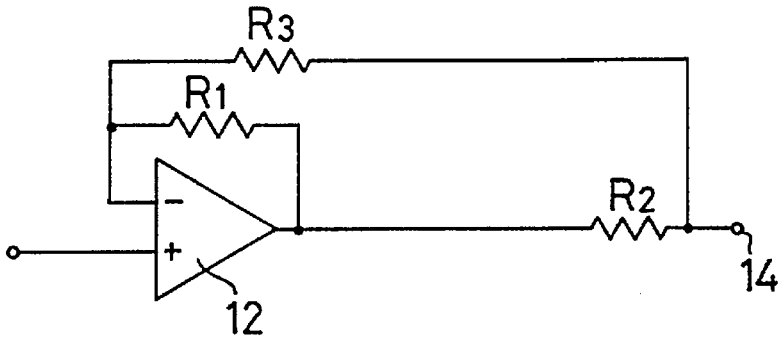
FIG. 4 is a circuit diagram of a voltage compensating circuit of a second embodiment of the present invention.
Figure 5:
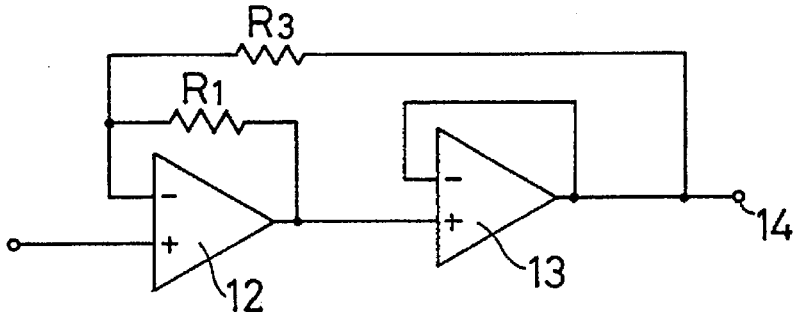
FIG. 5 is a circuit diagram of a voltage compensating circuit of a third embodiment of the present invention.
Figure 13A:
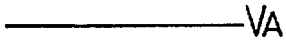
FIGS. 13A to 13C are views for explaining operational voltage waveforms of the first to third embodiments, respectively.
Figure 13B:
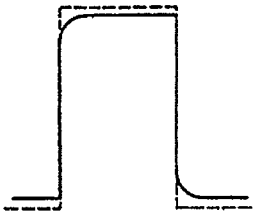
Figure 13C:
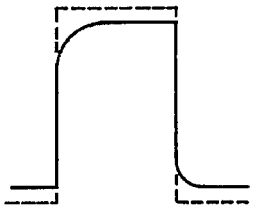

FIGS. 4 and 5 show variations of the circuit of FIG. 3. FIG. 4 shows the circuit of FIG. 3 from which the buffer 13 is removed. FIG. 5 shows the circuit of FIG. 3 from which the resistor R2 is removed. Since the buffer 13 is not always necessary when its degree of amplification is 1, it may be removed as shown in FIG. 4. Since the buffer 13 also performs the function of the resistor R2 when it has a resistor on its output side in an equivalent circuit thereof, the resistor R2 may be removed as shown in FIG. 5. However, in a case where an ideal buffer is employed as the buffer 13, the resistor R2 cannot be removed since the ideal buffer has no equivalent resistor on its output side. In FIG. 3, the buffer 13 may have a resistor at its output portion. In that case, the resistor and the resistor R2 function as output current monitoring impedance circuits. In the voltage compensating circuits of FIGS. 3 to 5, the output voltage (i.e. the voltage at the output terminal 14) is constant as shown in FIG. 13A. At this time, the output voltage at the scanning circuit 2 or the driver circuit 3 provided with a voltage from the voltage compensating circuit 11 is as represented by the solid line waveform of FIG. 13B, and the voltage applied to the pixel LC is as represented by the solid line waveform of FIG. 13C. In FIGS. 13B and 13C, the dotted line waveforms represent ideal voltage waveforms.

Figure 6:
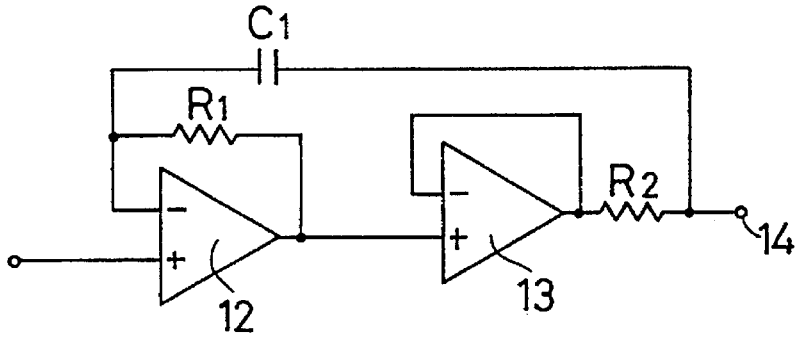
FIG. 6 is a circuit diagram of a voltage compensating circuit of a fourth embodiment of the present invention.
Figure 7:
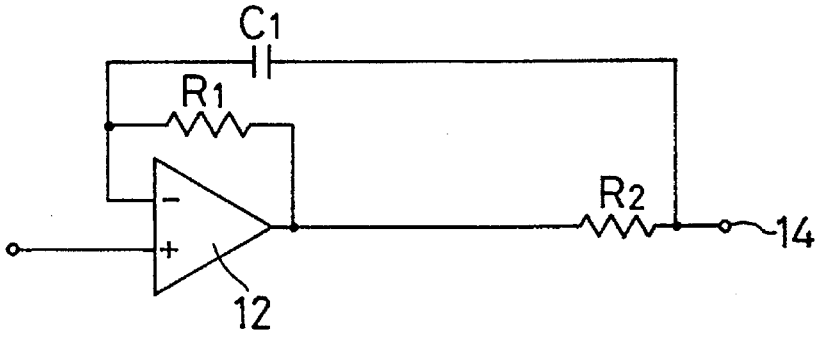
FIG. 7 is a circuit diagram of a voltage compensating circuit of a fifth embodiment of the present invention.
Figure 8:
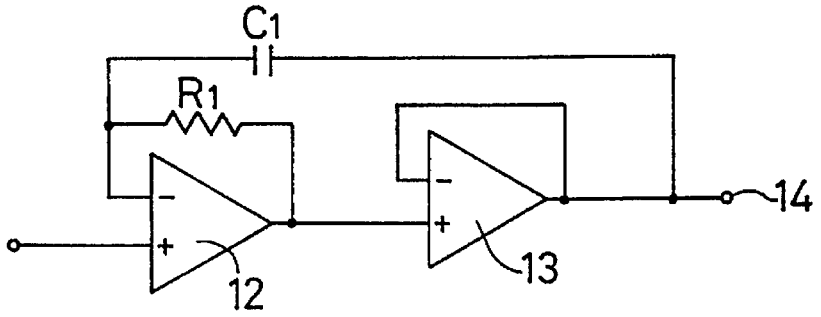
FIG. 8 is a circuit diagram of a voltage compensating circuit of a sixth embodiment of the present invention.
Figure 14A:
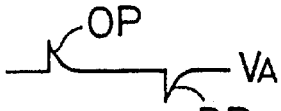
FIGS. 14A to 14C are views for explaining operational voltage waveforms of the fourth to sixth embodiments, respectively.
Figure 14B:
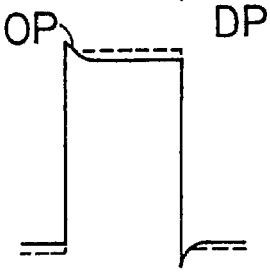
Figure 14C:
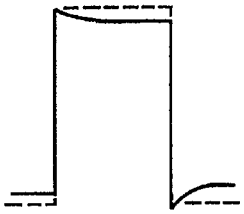

In the voltage compensating circuits of FIGS. 6, 7 and 8, an alternating current component of the voltage at the output terminal 14 is fed back to the operational amplifier 12. For that purpose, a capacitor C1 is connected between the output terminal 14 and the inverting terminal of the operational amplifier 12. The other portions of FIGS. 6, 7 and 8 are the same as those of FIGS. 3, 4 and 5, respectively. In each of the embodiments of FIGS. 6 to 8, the voltage at the output terminal 14 is as shown in FIG. 14A, and the waveform of the output voltage of the scanning circuit 2 or the driver circuit 3 is as represented by the solid line of FIG. 14B. At that time, the waveform of the voltage applied to the pixel LC is as represented by the solid line of FIG. 14C.

Figure 9:
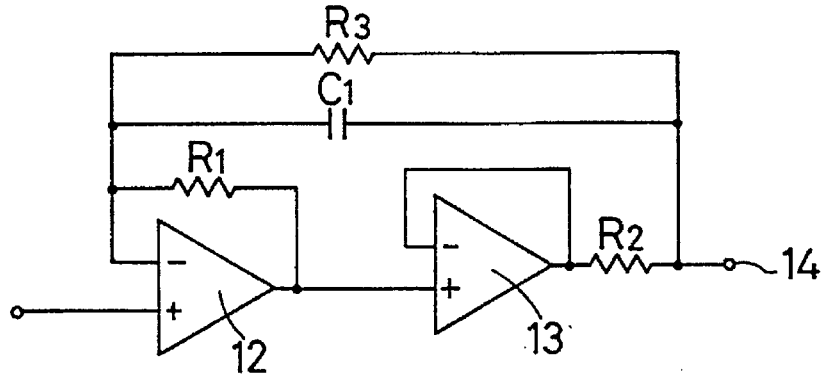
FIG. 9 is a circuit diagram of a voltage compensating circuit of a seventh embodiment of the present invention.
Figure 10:
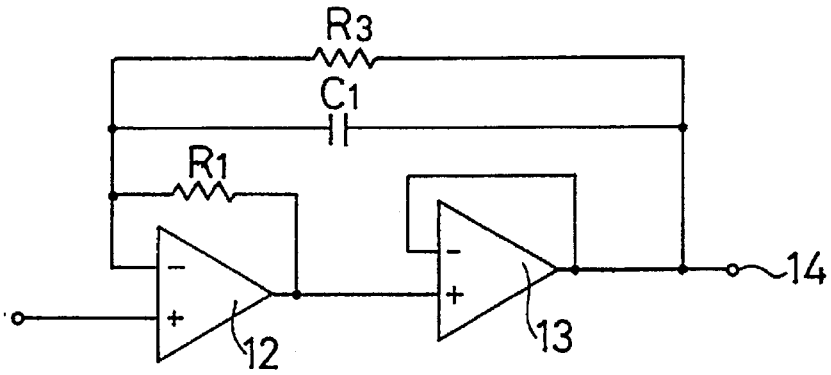
FIG. 10 is a circuit diagram of a voltage compensating circuit of an eighth embodiment of the present invention.
Figure 11:
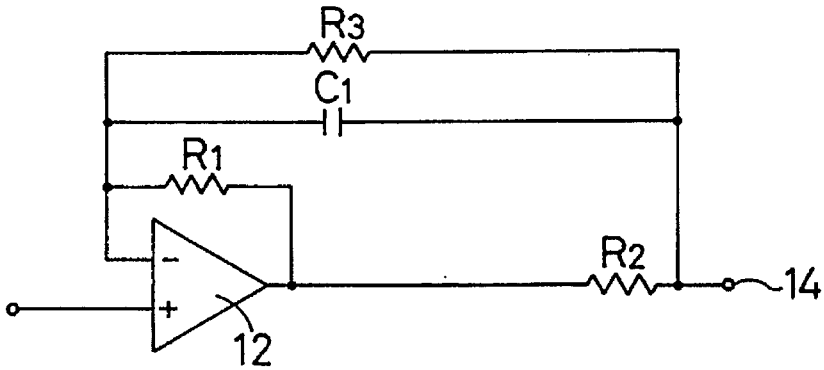
FIG. 11 is a circuit diagram of a voltage compensating circuit of a ninth embodiment of the present invention.
Figure 12:
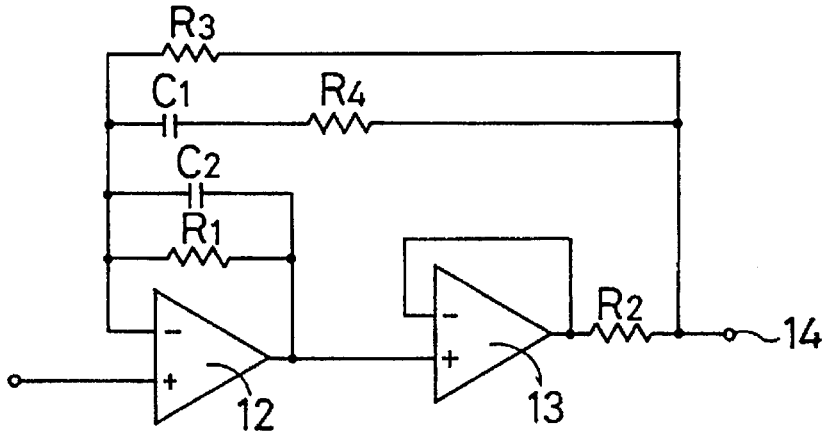
FIG. 12 is a circuit diagram of a voltage compensating circuit of a tenth embodiment of the present invention.
Figure 15A:
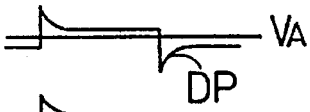
FIGS. 15A to 15C are views for explaining operational voltage waveforms of the seventh to tenth embodiments, respectively.
Figure 15B:
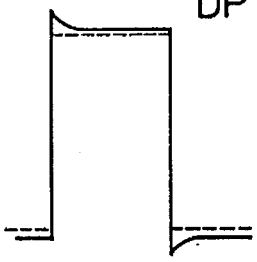
Figure 15C:
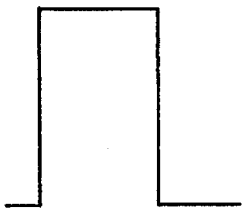
Figure 16:
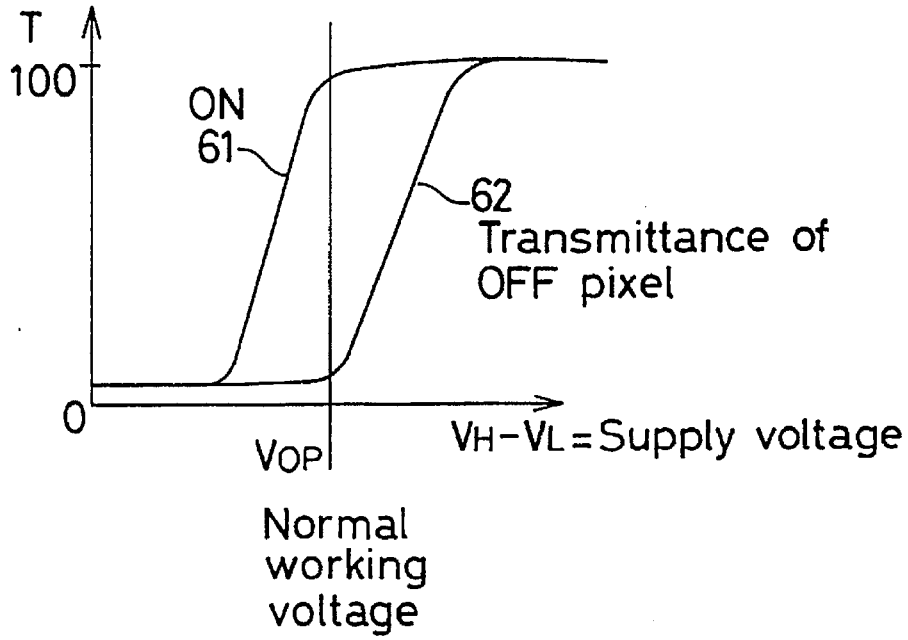
FIG. 16 is a view showing voltage-light transmittance characteristic of the liquid crystal cell.
Figure 17:
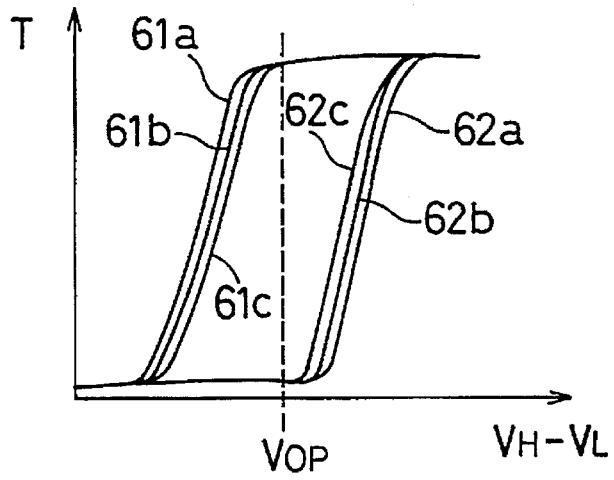
FIG. 17 is a view showing a voltage-light transmittance characteristic when a time-division number N is small.
Figure 18:
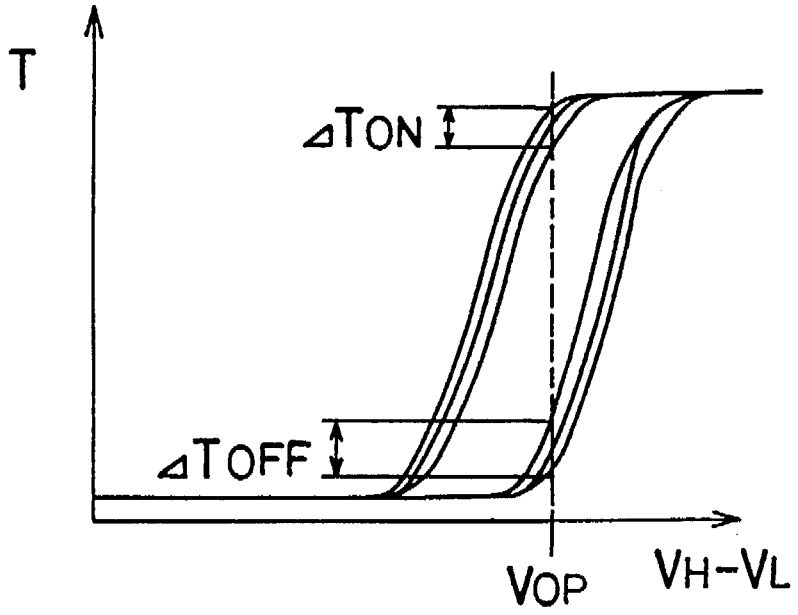
FIG. 18 is a view showing a voltage-light transmittance characteristic when the time-division number N is large.

In the embodiments shown in FIGS. 9, 10 and 11, both of the direct current component and the alternating current component of the voltage at the output terminal 14 are fed back to the operational amplifier 12. For that purpose, the resistor R3 and the capacitor C1 are connected between the output terminal 14 and the inverting input terminal of the operational amplifier 12. The capacitor C1 feeds back the alternating current component, while the resistor R3 feeds back the direct current component. The other portions of FIGS. 9, 10 and 11 are the same as those of FIGS. 3, 4 and 5, respectively. In the embodiment of FIG. 12, both of the direct current component and the alternating current component are fed back similarly to in the embodiments of FIGS. 9 to 11. In this embodiment, however, a resistor R4 is inserted in series in an alternating current feedback path including the capacitor C1. In addition, a capacitor C2 in parallel with the resistor R1 is inserted between the output terminal of the operational amplifier 12 and the inverting input terminal. The other portions are the same as those of FIG. 9. In the circuit of FIG. 12, the change may be made with respect to the buffer 13 and the resistor R2 as in the circuits of FIGS. 10 and 11. The output voltage of the voltage compensating circuits of FIGS. 10 to 12 are as shown in FIG. 15A. The direct current voltage rises relative to the level of the input voltage $V_A$. It is similar to the case of FIG. 14A in connection with FIGS. 6 to 8 that an overshoot op is generated at a rising portion and an undershoot dp is generated at a dropping portion of the period for which pulse voltages are being generated from the scanning circuit 2 or the driver circuit 3. The solid line waveform of FIG. 15B represents an output voltage waveform of the scanning circuit 2 or the driver circuit 3. The solid line waveform of FIG. 15C represents a voltage applied to the pixel LC.

When the above-mentioned voltage compensating circuit of FIG. 3 was incorporated in the lines of the non-selecting voltages $V_{DH}$ and $V_{DL}$ for a data circuit of the power supplying circuit 7, and 100×10 and 10×200 line-form images were drawn on a 200×560 dot-matrix display, no ghost appeared on either of the extensions of the images at room temperature. Moreover, when the liquid crystal display apparatus was incorporated in a word processor and was used for a week, although the ghost was sometimes observed, it was eliminated only by adjusting the display luminance. Further, when the voltage compensating circuit of FIG. 3 was used in the lines of a scanning-side non-selecting voltage and a data-side non-selecting voltage in a liquid crystal cell in which each pixel had a non-linear device and which had an effective display area corresponding to the size of B4, no ghost appeared even in a 1/350 duty driving cycle.

Moreover, the voltage compensating circuit of FIG. 9, where R1, R3 and C1 were set to R1=1 k Ω, R3=330 to 830 Ω and C1=10000 PF, respectively, was inserted in the lines of $V_{SH}$ and $V_{SL}$, and a buffer which was a mere voltage follower was inserted in the lines of $V_{DH}$ and $V_{DL}$ to carry out a 1/400 duty display driving cycle of a 1024000-pixel liquid crystal cell. No ghost was observed either when a black frame image was displayed on a white background and a white frame image was displayed on a black background in which the ghosts are most likely to appear and when bar charts of different widths were displayed. Further, ghosts did not become conspicuous even when the contrast (display density) was changed under that condition.

The voltage compensating circuit may be provided to any of the voltages $V_{DH}$, $V_{DL}$, $V_{SH}$ and $V_{SL}$ required for driving the liquid crystal cell by the voltage averaging method, or the voltage compensating circuit may be provided to all of them. The scanning circuit side non-selecting voltages $V_{SH}$ and $V_{SL}$ are used as references of the driving voltage of the liquid crystal cell. Since these voltages are used at a time rate of (N−1)/N where N represents a time-division number, they are used for almost the entire time period when N increases. Hence, it is preferable to provide the voltage compensating circuit at least to the lines of $V_{SH}$ and $V_{SL}$. At the lines of $V_L$ and $V_H$, since currents flow only in one direction and the output impedance of a power source which supplies power to those lines is low, voltage variations are small. Hence, it is not very necessary to provide the voltage compensating circuit to the lines of $V_L$ and $V_H$.

Obviously, many modifications and variations of the present invention are possible in light of the above teachings. It is therefore to be understood that within the scope of the appended claims, the invention may be practiced other than as specifically described.

What is claimed is:

1. A liquid crystal display apparatus comprising:

a liquid crystal cell including a first electrode group and a second electrode group which intersect each other;

a scanning circuit connected to the first electrode group;

a driver circuit connected to the second electrode group;

a power supplying circuit for providing to the scanning circuit and to the driver circuit a selecting voltage and a non-selecting voltage so that the liquid crystal cell is driven by a voltage averaging method; and a voltage compensating circuit provided to the power supplying circuit for compensating for an output voltage of the power supplying circuit in accordance with a value of an output current of the power supplying circuit, said voltage compensating circuit comprising an operational amplifier having a first input terminal, a second input terminal, and an output terminal, wherein a predetermined voltage is provided to the first input terminal, an impedance circuit connected to the output terminal of the operational amplifier at one end and to an output terminal of the power supplying circuit at another end, a first resistor connected to the second input terminal of the operational amplifier at one end and to a connection point of the output terminal of the operational amplifier and the impedance circuit at another end, and feedback means for feeding back an output of the impedance circuit to the operational amplifier, said feedback means being connected to the output terminal of the power supplying circuit at one end and to the second input terminal of the operational amplifier at another end.

2. A liquid crystal display apparatus according to claim 1, wherein said feedback means includes a second resistor.

3. A liquid crystal display apparatus according to claim 2, wherein said impedance circuit includes a third resistor.

4. A liquid crystal display apparatus according to claim 2, wherein said impedance circuit includes a buffer.

5. A liquid crystal display apparatus according to claim 2, wherein said impedance circuit includes a buffer and a third resistor, said third resistor being connected to an output end of the buffer.

6. A liquid crystal display apparatus according to claim 1, wherein said feedback means includes a capacitor for feeding back an alternating current component of an output of the impedance circuit.

7. A liquid crystal display apparatus according to claim 6, wherein said impedance circuit includes a third resistor.

8. A liquid crystal display apparatus according to claim 6, wherein said impedance circuit includes a buffer.

9. A liquid crystal display apparatus according to claim 6, wherein said impedance circuit includes a buffer and a third resistor, said third resistor being connected to an output end of the buffer.

10. A liquid crystal display apparatus comprising:

a liquid crystal cell including a first electrode group and a second electrode group which intersect each other;

a scanning circuit connected to the first electrode group;

a driver circuit connected to the second electrode group;

a power supplying circuit for providing to the scanning circuit and to the driver circuit a selecting voltage and a non-selecting voltage so that the liquid crystal cell is driven by a voltage averaging method; and a voltage compensating circuit provided to the power supplying circuit for compensating for an output voltage of the power supplying circuit in accordance with a value of an output current of the power supplying circuit, said voltage compensating circuit comprising an operational amplifier having a first input terminal, a second input terminal, and an output terminal, wherein a predetermined voltage is provided to the first input terminal, an impedance circuit connected to the output terminal of the operational amplifier at one end and to an output terminal of the power supplying circuit at another end, a first resistor connected to the second input terminal of the operational amplifier at one end and to a connection point of the output terminal of the operational amplifier and the impedance circuit at another end, and feedback means for feeding back both of an alternating current component and a direct current component of an output of the impedance circuit to the operational amplifier, said feedback means being connected to the output terminal of the power supplying circuit at one end and to the second input terminal of the operational amplifier at another end.

11. A liquid crystal display apparatus according to claim 10, wherein said feedback means includes a capacitor for feeding back the alternating current component and a second resistor for feeding back the direct current component.

12. A liquid crystal display apparatus according to claim 10, wherein said impedance circuit includes a third resistor.

13. A liquid crystal display apparatus according to claim 10, wherein said impedance circuit includes a buffer.

14. A liquid crystal display apparatus according to claim 10, wherein said impedance includes a buffer and a third resistor, said third resistor being connected to an output end of the buffer.

* * * * *